United States Patent [19]

Salvadore et al.

[11] 3,937,269

[45] Feb. 10, 1976

[54] MOLD POWDER COMPOSITION AND METHOD FOR CONTINUOUSLY CASTING EMPLOYING THE SAME

[75] Inventors: Eugene A. Salvadore, Coraopolis, Pa.; Paul J. Zimmerman, Grosse Ile, Mich.

[73] Assignee: Crucible Inc, Pittsburgh, Pa.

[22] Filed: Apr. 8, 1974

[21] Appl. No.: 458,745

[52] U.S. Cl. ..... 164/73; 106/38.27; 106/286

[51] Int. Cl.[2] ..... B22D 11/08

[58] Field of Search ..... 164/73; 106/38.27, 286; 148/26

[56] References Cited

UNITED STATES PATENTS

| | | | |
|---|---|---|---|
| 3,677,325 | 7/1972 | Austin | 164/73 |
| 3,708,314 | 1/1973 | Kishida | 106/38.27 |
| 3,814,166 | 6/1974 | Watts | 164/73 |

OTHER PUBLICATIONS

Chem. Abst. 66: 118 206N, 1966.

*Primary Examiner*—Theodore Morris

[57] ABSTRACT

A mold flux powder composition and method for employing the same in the continuous casting of metals, particularly the continuous casting of stainless steel using a submerged-nozzle casting practice. The mold powder composition is, in percent by weight, 30 to 60 fly ash, preferably 40 to 55 fly ash, 10 to 30 calcium fluoride, preferably 10 to 25 calcium fluoride, up to 15 sodium carbonate, up to 15 calcium carbonate, up to 10 cryolite, up to 10 sodium borate, 2 to 8 graphite, 4 to 12 manganese oxide, preferably 5 to 10 manganese oxide, up to 15 powdered glass, and up to 5 iron oxide.

1 Claim, No Drawings

MOLD POWDER COMPOSITION AND METHOD FOR CONTINUOUSLY CASTING EMPLOYING THE SAME

In submerged nozzle continuous casting, molten metal is teemed from a tundish through a nozzle into a flow-through mold having a mold cavity that is typically copper and water cooled; from the base of the mold an embryo casting having a solidified skin and a molten interior is continuously withdrawn, as by the use of pinch rolls. With a submerged-nozzle continuous-casting technique the refractory nozzle has its base located below the molten metal level in the mold.

For purposes of facilitating the passage of the partially solidified continuous casting through the mold, and particularly in the continuous casting of steel, such as stainless steel, it is customary to provide a lubricant between the metal being cast and the copper mold walls. For this purpose various lubricants have been used, such as unsaturated fatty oils, such as rapeseed oil. These materials are expensive and more important tend to decompose in the presence of the heat of the molten metal and consequently lose their lubricating properties. Alternately, it is known to use flux-type materials as lubricants which melt to give a glass-like lubricant. Typically these lubricants are compositions including blast furnace slag, fly ash and high melting point silicates. The lubricants of this type must, of course, become sufficiently viscous for the purpose at the particular metal casting temperature with which they are used, or otherwise they will not be effective for the purpose. It is known to accomplish adjustment of the melting or fusion temperature of lubricants of this type to achieve the desired viscosity by the addition of fluorides, such as calcium fluoride. The addition of excessive amounts of fluorides for this purpose can create a health hazard by producing fluorine-containing fumes during the casting operation. In addition, and particularly in the casting of stainless steels wherein a submerged nozzle, customarily made of an alumina-graphite composition, is employed, the presence of fluorides in amounts significantly exceeding about 20 to 25% by weight of the composition will erode the refractory of the nozzle, thus contributing to the failure and ultimate breakage of the submerged nozzle at the slag line in the mold.

It is accordingly a primary object of the present invention to provide a method and a mold powder composition for continuous casting, and particularly the continuous casting of stainless steels wherein a submerged-nozzle technique is employed that provides the combination of the required lubricity at the prevailing temperatures, insulation of the molten metal pool in the continuous casting mold, absorption and floating-out of nonmetallic inclusions, protection of the molten metal pool surface from oxidation and will not cause significant erosion of the submerged refractory nozzle. In addition, thermal properties are provided to allow sufficient but not excessive or localized heat transfer in the upper portion of the mold and by continuously filling the shrinkage cavity between the casting skin and mold cavity wall in the lower portion of the mold heat removal from the cast metal is increased to increase the thickness and strength of the casting skin. Broadly in the practice of the invention the mold flux powder compositions listed in Table I are employed.

TABLE I

| | | |
|---|---|---|
| Fly ash | 30–60%, | 40–55% |
| Calcium fluoride | 10–30%, | 10–25% |
| Sodium carbonate | 0–15% | |
| Calcium carbonate | 0–15% | |
| Cryolite | 0–10% | |
| Sodium borate | 0–10% | |
| Graphite | 2–8% | |
| Manganese oxide | 4–12%, | 5–10% |
| Powdered glass | 0–15% | |
| Iron oxide | 0–5% | |

Within the limits of Table I, the mold flux powder composition is varied to achieve a fusion temperature for the powder within the range of 1700° to 1900°F. The fusion temperature will be selected to correspond with the liquidus temperature of the stainless steel composition with which the powder is used in a continuous casting operation. The particle size of the mold flux powder is generally minus 100 mesh, U.S. Standard.

The mold material of the invention is introduced to the surface of the liquid metal pool in the continuous casting mold to cover completely said surface during the entire teeming operation. Typically in the continuous casting of stainless steels, and particularly austenitic stainless steels, the usage of the flux material will be about three quarters pound thereof per ton of steel cast. This is significantly less flux material per ton of steel cast than used when conventional flux materials are employed in similar continuous casting operations. This, therefore, additionally reduces the quantity of fluorine fumes produced during the casting operation and also the quantity of fluorine present to attack the refractory of the nozzle. Upon introduction of the flux material it will, because of proper adjustment of the fusion or melting temperature thereof in accordance with the temperature of the metal in the continuous casting mold be of the viscosity required to provide a layer on top of the molten pool in the mold and propagate along the mold walls between the metal and the mold walls thus providing a lubricating effect necessary to facilitate withdrawl of the casting from the mold as well as the necessary thermal properties throughout the entire teeming operation. The submerged refractory nozzle of the tundish through which the metal is teemed to the mold will extend through the layer provided by the mold powder and into the molten pool within the casting mold. By minimizing the amount of fluoride present in the mold powder composition attack of the refractory of the nozzle is minimized to the point where such does not significantly erode even during relatively long casting cycles.

To achieve the above-discussed objects with respect to the function of the mold powder composition in accordance with the invention it is necessary to maintain the constituents thereof within the ranges set forth in Table I. With respect to the fly ash content, this provides a source of $SiO_2$ and $Al_2O_3$. When powdered glass is used such is also a source of $SiO_2$ so that the amount of fly ash employed can be correspondingly reduced to in turn reduce the $Al_2O_3$ content. The $Al_2O_3$ increases the viscosity of the mold powder and consequently in applications wherein the molten metal temperature is such that for proper viscosity the $Al_2O_3$ content should be reduced powdered glass may be substituted for a portion of the fly ash to accordingly reduce the overall $Al_2O_3$ content while maintaining the $SiO_2$ content at the desired level.

In the casting of stainless steel calcium fluoride is a well-known addition to mold powders of this type for the purpose of reducing the viscosity but, as pointed out hereinabove, tends to cause erosion of the submerged refractory pouring nozzle. The calcium fluoride, in accordance with the present invention, may be maintained at a level sufficiently low to minimize erosion of the pouring nozzle by substituting manganese oxide. Manganese oxide has been found to achieve the desired lowering of the viscosity of the mold powder much like calcium fluoride. Consequently by the use of manganese oxide and the reduction in the amount of calcium fluoride one is able for the first time to get the desired relatively low viscosity not otherwise characterizing these relatively high melting point mold powders while minimizing refractory erosion of the submerged nozzle. As mentioned hereinabove a maximum of about 20 to 25% by weight of fluorides is generally the tolerable limit with respect to nozzle erosion. To provide the desired lubricity graphite is employed within the range of 2 to 8%. Optional additions of sodium carbonate may be used as well as optional additions of calcium carbonate to lower the melting point of the mold powder and thus decrease viscosity. In addition they have a fluidizing or stirring effect which enhances the even spreading or flowing of the powder over the surface of the molten pool in the mold during application and prior to melting. This serves to enhance the insulating effect of the powder upon immediate application to the surface of the molten pool in the mold.

Likewise optional additions of lime may be used to increase the melting point of the mold powder and lime is particularly effective for this purpose in applications where high melting point mold powders are required. Optional additions of cryolite (sodium aluminum fluoride) may be employed to increase fluidity. Optional additions of sodium borate are employed to adjust the melting temperature and increase fluidity. The melting temperature of the composition will decrease in the presence of increasing amounts of sodium borate. Likewise, iron oxide increases fluidity and although not as effective for this purpose as manganese oxide may be used in conjunction therewith for this purpose. Principally it is employed to replace the iron oxide which is incidentally present in the fly ash when, as above described, the fly ash content is decreased in the presence of an optional addition of powdered glass.

In addition to providing the advantages discussed hereinabove with regard to the continuous casting of stainless steels by a submerged nozzle technique, the mold powder is easily manufactured in that all that is required is a mixing and tumbling of the constituents of the mold powder in conventional well-known apparatus for this purpose.

As a specific example of the practice of the invention the following specific mold powder compositions in accordance with the present invention were compared, as shown in Table II:

TABLE II

| | FC 3 | FC 4 | SS3-1 | SS3-2 |
|---|---|---|---|---|
| Fly ash | 54.0% | 54.0% | 39.0% | 39.0% |
| Calcium fluoride | 16.0 | 14.0 | 16.5 | 16.0 |
| Sodium carbonate | 5.0 | 5.0 | 5.0 | 5.0 |
| Calcium carbonate | 5.0 | 5.0 | 5.0 | 5.0 |
| Lime | — | 6.0 | — | — |
| Cryolite | 5.0 | 2.0 | 5.5 | 5.0 |
| Sodium borate (ANHYD) | 4.0 | — | 4.0 | 4.0 |
| Graphite | 5.0 | 5.0 | 6.0 | 5.5 |
| Manganese oxide | 6.0 | 9.0 | 6.5 | 8.0 |
| Powdered glass | — | — | 10.0 | 10.0 |
| Iron oxide | — | — | 2.5 | 2.5 |
| Fusion temp. (°F) | 1800 | 1850 | 1750 | 1750 |

The typical specific compositions listed in Table II are each adjusted with respect to the constituent balance for specific stainless steel grades. Specifically, flux material FC 3 would generally be used with the lower alloy content stainless steels, such as AISI Types 301 and 304. The flux materials identified as SS3-1 and SS3-2 would be used with the more highly alloyed grades, such as Type 316. The material identified as FC 4 would generally be used in the continuous casting of ferritic stainless steels.

The term "fusion temperature" as used herein means the temperature at which the constituents of the mold flux powder totally melt together.

We claim:

1. In the continuous casting of stainless steel wherein said steel is teemed from a tundish to a flow-through continuous-casting mold via a submerged refractory nozzle from which a continuous, embryo casting is withdrawn, the improvement comprising the introduction to said mold during the teeming operation of a mold powder of the composition consisting essentially of, in percent by weight, 30 to 60 fly ash, 10 to 25 calcium fluoride, up to 15 sodium carbonate, up to 15 calcium carbonate, up to 10 cryolite, up to 10 sodium borate, 2 to 8 graphite, 4 to 12 manganese oxide, up to 15 powdered glass, up to 5 iron oxide.

* * * * *